United States Patent [19]

Kiriake

[11] Patent Number: 4,718,560

[45] Date of Patent: Jan. 12, 1988

[54] DEVICE FOR TRANSPORTING DIFFERENT KINDS OF ARTICLES

[75] Inventor: Masaharu Kiriake, Kyoto, Japan

[73] Assignee: Murata Kikai Kabushiki Kaisha, Japan

[21] Appl. No.: 649,906

[22] Filed: Sep. 12, 1984

[30] Foreign Application Priority Data

Sep. 16, 1983 [JP] Japan ..... 58-143565[U]

[51] Int. Cl.[4] ..... B07C 5/36; B65H 67/06

[52] U.S. Cl. ..... 209/656; 198/465.1; 198/803.12; 209/927; 209/940; 242/35.5 A

[58] Field of Search ..... 209/606, 615, 656, 658, 209/688, 927, 940, 922, 621, 925; 198/651, 472, 358, 580, 367, 465.1, 465.2, 803.01, 803.12, 445, 446; 242/35.5 A; 57/264, 266, 268, 270, 271, 276

[56] References Cited

U.S. PATENT DOCUMENTS

| | | | |
|---|---|---|---|
| 2,630,223 | 3/1953 | Wayland et al. | 209/925 |
| 2,833,393 | 5/1958 | Kay | 198/580 |
| 3,156,360 | 11/1964 | Count et al. | 209/656 |
| 4,025,421 | 5/1977 | Mueller | 209/656 |
| 4,463,909 | 8/1984 | Kiriake et al. | 242/35.5 A |
| 4,545,551 | 10/1985 | Uchida et al. | 242/35.5 A |

FOREIGN PATENT DOCUMENTS

| | | | |
|---|---|---|---|
| 1253939 | 1/1961 | France | 209/586 |
| 587766 | 4/1958 | Italy | 198/367 |
| 119623 | 9/1980 | Japan | 209/927 |
| 152767 | 9/1983 | Japan | 242/35.5 A |

*Primary Examiner*—Robert B. Reeves
*Assistant Examiner*—Donald T. Hajec
*Attorney, Agent, or Firm*—Spensley Horn Jubas & Lubitz

[57] ABSTRACT

A device for sorting and transporting a plurality of different kinds of articles comprises three belt conveyors disposed in adjacent parallel relationship to each other, two of the belt conveyors moving in a direction opposite to each other, guide members for dividing transporting faces of the two oppositely moving belt conveyors into some areas, and a sorting device for identifying and sorting articles transported on the belt conveyor to the respective areas.

2 Claims, 8 Drawing Figures

DEVICE FOR TRANSPORTING DIFFERENT KINDS OF ARTICLES

BACKGROUND OF THE INVENTION

1. Field of the Invention

This invention relates to a device for sorting and transporting a plurality of different kinds of articles in order that the articles may be treated by same or different processes in different treating areas for the articles.

2. Prior Art

In the case a plurality of different kinds of articles are sorted and transported to different areas for individual kinds thereof by means of a conveyor in order that the articles may be treated by some processes there, if transporting paths are provided for the individual kinds of the articles, a floor area occupied by such transporting paths will be increased in proportion to an increase of the number of kinds of articles. For example, where a single automatic winder in a spinning mill is used for rewinding of a plurality of kinds of yarns at a time, if conveyors are provided individually for winding sections for treating the individual yarns, transporting paths will sometimes occupy even a greater floor area than the winder does. Although an arrangement of conveyors in overlapping relationship one above another will result in reduction of a floor area occupied thereby, this will require circulation of conveyors in vertical directions, resulting in complication of the structure. In addition, the provision of transporting paths for individual articles is also disadvantageous in that it cannot easily cope with increase or decrease of kinds of articles.

SUMMARY OF THE INVENTION

An object of the present invention is to provide a compact and simple device for transporting a plurality of differnt kinds of articles in order that the articles may be sorted to different areas and be treated by same or different processes in the different areas for the articles.

According to the present invention, a device for sorting and transporting a plurality of different kinds of articles in order that the articles may be treated by same or different processes in different treating areas for the articles is characterized in that it comprises three belt conveyors disposed in mutually adjacent parallel relationship to each other, guide members for controlling directions of movement of articles transported by said belt conveyors, an means for identifying and sorting articles on said conveyors, the central one of said belt conveyors moving in a direction opposite to the direction of movement of the outer one of said conveyors, said guide members being designed such that they divide transporting faces of the two oppositely moving central and outer belt conveyors into zones the number of which is equal to the number of kinds of the articles while they move articles form one to the other to the two belt conveyors at end portions of said zones so as to form, together with the two belt conveyors, circulating paths the number of which is equal to the number of kinds of the articles, each of said circulating paths having along the outer belt conveyor an article delivering port for laterally taking out an article for intended treatment, said means for identifying and sorting articles being designed to individually identify kinds of different articles transported on the other outer conveyor so as to cause the thus identified articles to be moved for the individual kinds on the inner belt conveyor of different circulating paths.

DETAILED DESCRIPTION OF THE INVENTION

Now, the present invention will be described in connection with an example in which the invention is applied for sorting and supplying a plurality of different yarns to an automatic winder as described above.

Figure 1:
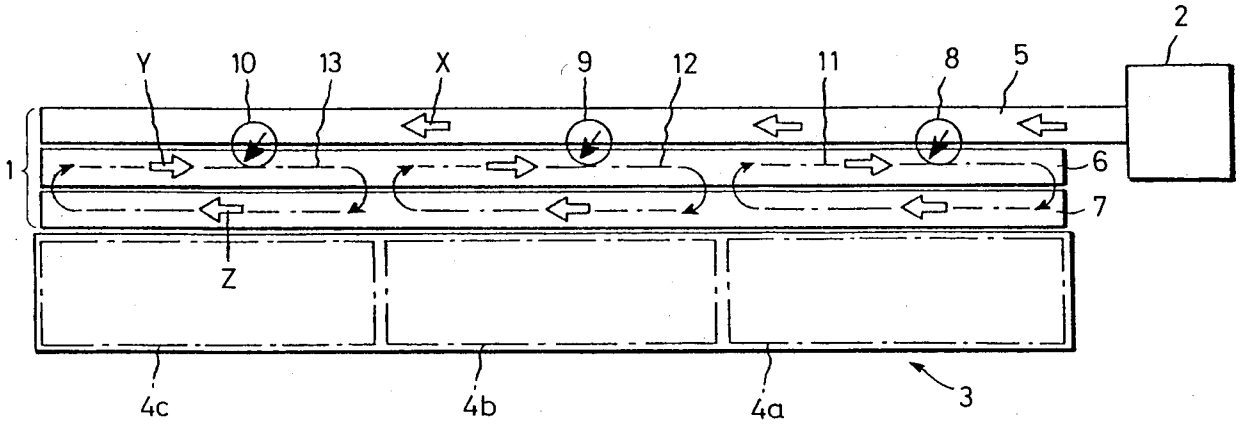
FIG. 1 is a plan view showing, in diagrammatic representation, an example of a transporting device of the present invention in use.
Figure 2:
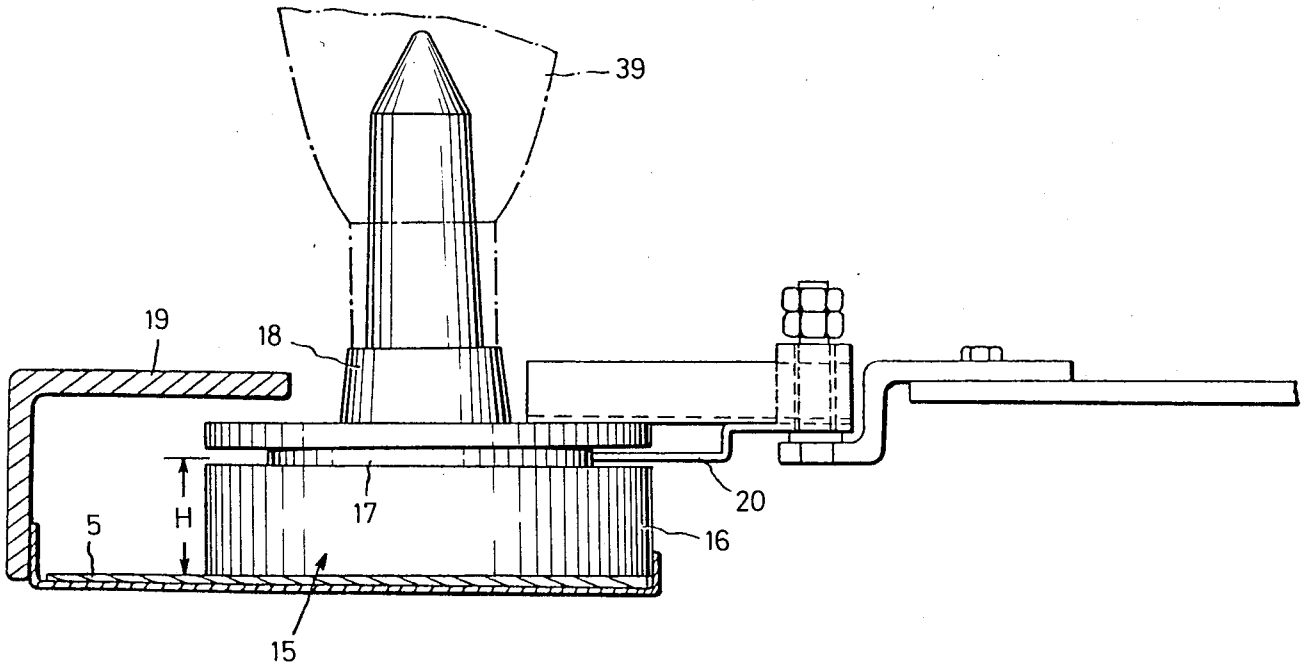
FIG. 2 is a side elevational view, partly in vertical section, showing one embodiment of a spinning bobbin transporting mechanism.

FIG. 1 is a plan view showing, in diagrammatic representation, a transporting device 1 of the present invention which is used as a spinning bobbin transporting device between an automatic spinning bobbin supplying device 2 and an automatic winder 3. In this application, three different kinds of spinning bobbins having yarns of different qualities thereon are supported on carriers and are supplied at random from the automatic spinning bobbin supplying device 2. The automatic winder 3 treats and effects winding of yarns of spinning bobbins of the kind A at a winding section 4*a* thereof, spinning bobbins of the kind B at another winding section 4*b*, and spinning bobbins of the kind C at a further winding section 4*c* (each winding) section includes winding mechanisms for five units). The winding mechanism will be explained hereinafter referring to FIG. 6. The transporting device 1 effects sorting of spinning bobbins necessary for this and transports the thus sorted spinning bobbins to the respective winding sections where they are to be treated. The transporting device 1 includes three belt conveyors 5, 6 and 7, a guide member which is omitted in FIG. 1, and spinning bobbin sorting mechanisms 8, 9 and 10. In the drawings, arrow marks X, Y and Z indicate directions of circulation of the belt conveyors 5, 6 and 7, respectively. Spinning bobbins 39 from which ends of yarns have been found and picked up at a yarn end feeder (not shown) advance in a leftward direction on the belt conveyor 5 while they are individually held supported uprightly on carriers 15 as shown in FIG. 2, and at a position adjacent the spinning bobbin sorting mechanism 8, spinning bobbins of the kind A are sorted out and transferred onto the belt conveyor 6. The spinning bobbins thus transferred onto the belt conveyor 6 are introduced into a circulating path 11 by the oppositely moving belt conveyors 6 and 7 and by an action of the guide plate not shown. Similarly, at a position adjacent the spinning bobbin aorting mechanism 9, spinning bobbins of the kind B are sorted out and introduced into a circulating path 12 on the belt conveyors 6 and 7, and at a position adjacent the spinning bobbins sorting mechanism 10, spinning bobbins of the kind C are transferred into a circulating path 13 on the belt conveyors 6 and 7. As shown in the drawings, the circulating path 11 is located adjacent the winding section 4a, the circulating path 12 is located adjacent the winding section 4b, and the circulating path 13 is located adjacent the winding section 4c. Besides, since, between a winding mechanism of each of the winding sections and the belt conveyor 7, there is a mechanism for feeding a new spinning bobbin from the conveyor 7 and delivering it into the winding mechanism after the winding mechanism has unwound a yarn from the spinning bobbin and discharged the thus emptied bobbin. Spinning bobbins introduced into any circulating path will thereby be taken into any of the winding mechanisms of a winding section adjacent the circulating path while they are circulated along the circulating path.

Details of individual components will be described below.

Figure 3A:
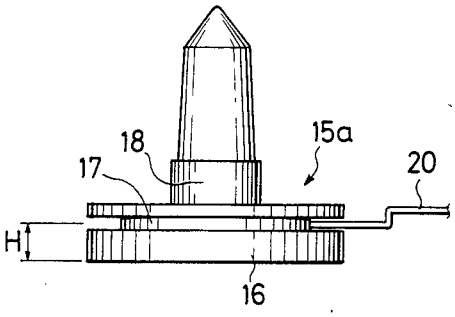
FIGS. 3*a*, 3*b* and 3*c* are side views of carriers for supporting and conveying spinning bobbins thereon.
Figure 3B:
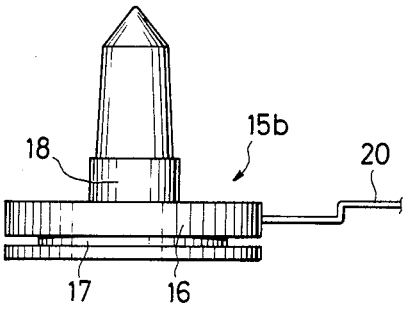
Figure 3C:
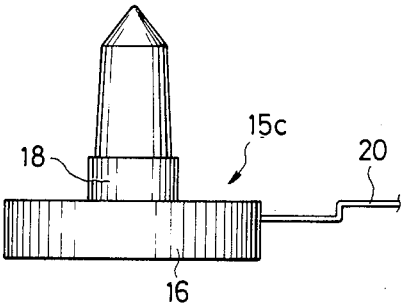
Figure 4:
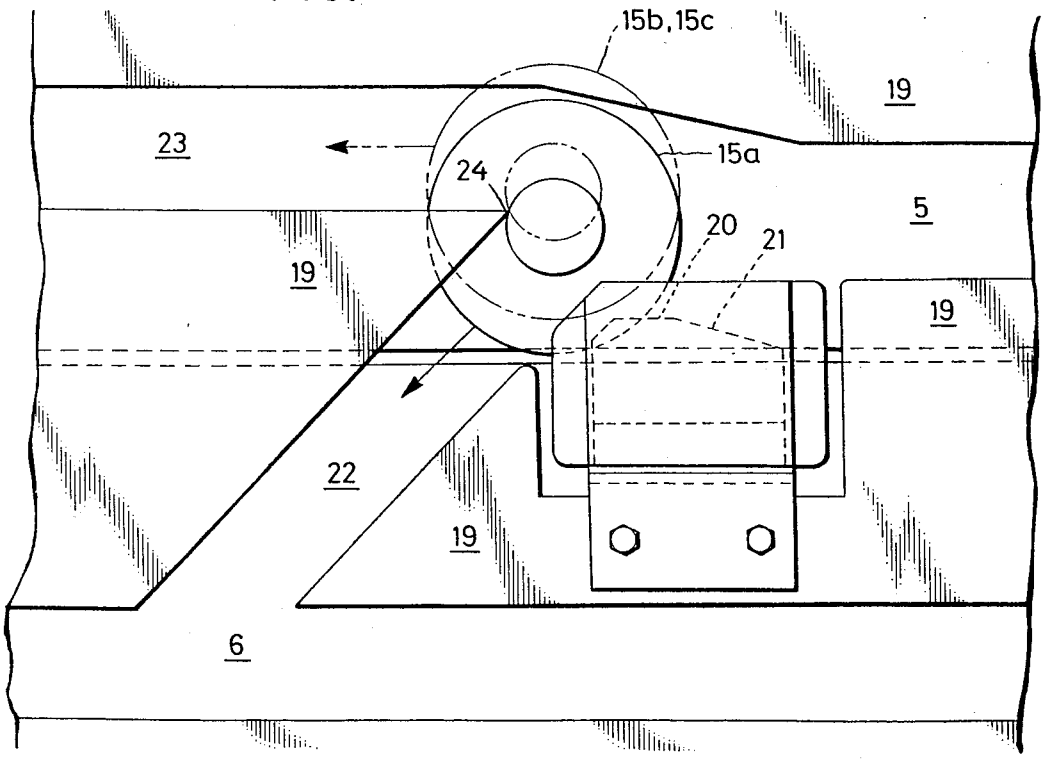
FIG. 4 is a plan view, in diagrammatic representation, showing one embodiment of a spinning bobbin sorting mechanism.

FIGS. 2, 3 and 4 are detailed schematic representations of the spinning bobbin sorting mechanism 8.

As seen from FIG. 2, a carrier 15 which is transported on the belt conveyor 5 and fittedly supports a spinning bobbin 39 thereon has, as an identification mark for the kind of the spinning bobbin 39 surpported on the carrier 15, an annular identifying groove 17 formed around a base plate portion 16 thereof in the form of a disk. The height H at which the identification groove 17 is positioned is differentiated depending upon kinds of spinning bobbins. As example, three kinds of carriers 15a, 15b, and 15c for supporting different kinds of spinning bobbins, respectively. are shown in FIGS. 3a, 3b and 3c. Thus, the carrier 15a on which the spinning bobbin 39 is fitted is controlled by a guide plate 19 secured at such a height above the belt conveyor as to engage with a body portion 18 of the carrier 15 so that it is placed onto a substantially central position of the belt conveyor 5. Thus, as the carrier 15a advances from the right to the left of FIG. 4 and comes to a position at which a sorting gage 20 extends from the belt conveyor 6 so as to engage with the base plate portion 16 of the carrier 15, a carrier 15a having the identification groove 17 at the height H which coincides with a height of installation of the sorting gage 20 (height from a conveyor face) is not intervened by the sorting gage 20 and thus advances straightforwardly, while other carriers 15b and 15c are abutted at base plate portions 16 thereof by the sorting gage 20 and are thus displaced upwardly in FIG. 4 on the belt conveyor 5 while they advance along a tapered portion 21. The carrier 15a which comes to a position in which the guide plate 19 forms a branch path 22 to the belt conveyor 6 is prevented from moving straightforwardly and is thus introduced into the branch path 22 by an acutely angled end portion 24 of the guide plate 19 at the branch portion which is located to abut against a front left portion of the carrier 15a advanced thereto and against a front right portion of a carrier 15b or 15c which has been displaced as described hereinabove. The carrier 15a thus introduced into the branch path 22 is then transferred onto the belt conveyor 6 and is circulated on the circulating path 11. Meanwhile, when a carrier 15b or 15c is abutted against the end portion 24 of the guide plate 19, it is introduced into a straight path 23 and is thus continued to be transported on the belt conveyor 5.

Sorting of spinning bobbins of the kind A is effected in the manner as described just above, and sorting of spinning bobbins of the other kinds supported on the carrier 15b and 15c is effected by the spinning bobbin sorting mechanisms 9 and 10.

Figure 5:
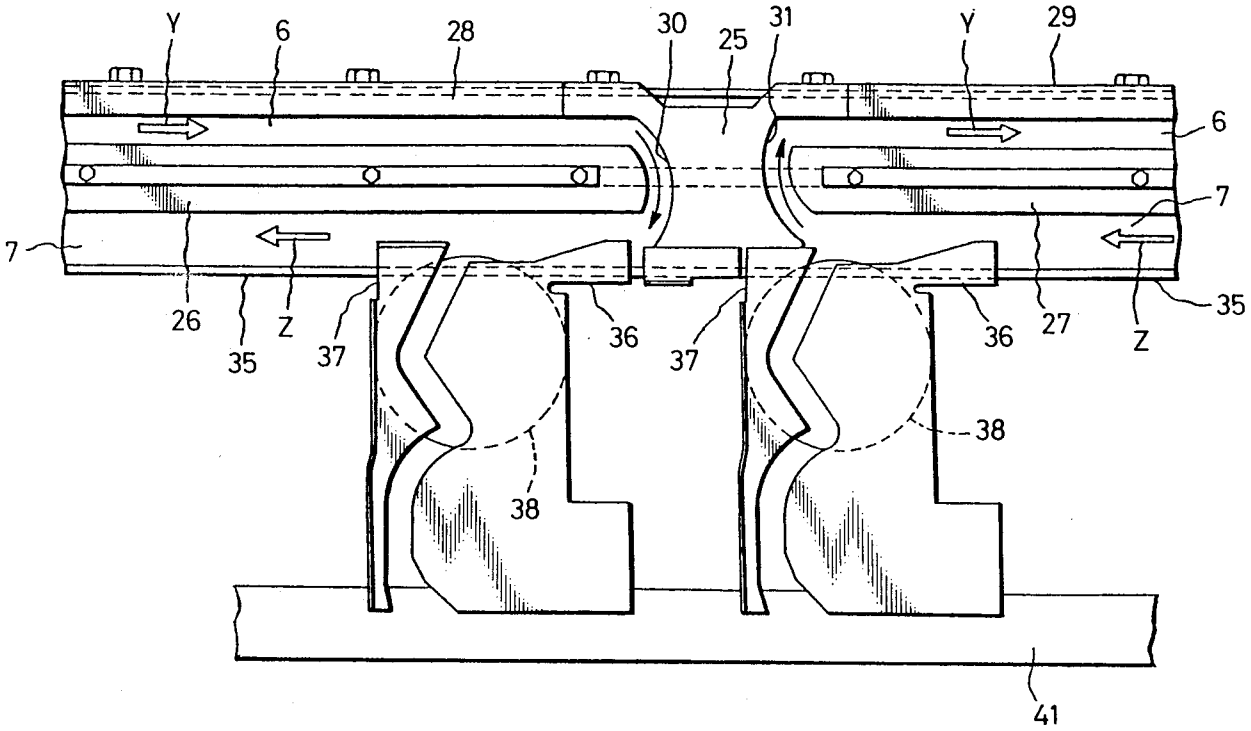
FIG. 5 is an enlarged view of a part of the transporting device of FIG. 1.

FIG. 5 is an enlarged plan view around a boundary between the circulating paths 11 and 12, illustrating a configuration of the guide plate constituting the circulating path. Guide plates 25 to 29 constitute fixed guides which engage with a body portion 18 of a carrier 15 to guide the carrier 15, similarly to the guide plate above the belt conveyor 5. The guide plate 25 is secured so as to cross transporting paths provided by the belt conveyors 6 and 7, and since guide ends 30 and 31 thereof are each formed to have a concave curved edge, they have a function to guide a carrier 15 which has come thereto onto the adjacent belt conveyor 6 or 7. A similar guide plate is also located above each of the belt conveyors and at opposite ends of each of the belt conveyors, and thus the three circulating paths 11 to 13 are constituted. It is to be noted that a portion 35 of each circulating path on the belt conveyor 7 adjacent the automatic winder 3 has no guide plate provided therefor and thus forms a delivering port for taking out a spinning bobbin 39 laterally of the belt conveyor 7. Reference numearl 36 and 37 designate each a guide member (guide members for only two winding units are shown) which extends above the belt conveyor 7 from the winder 3 side (a spinning bobbin on the conveyor 7 is taken into the automatic winder 3 by an action of the guide members and a rotary disk 38).

Figure 6:
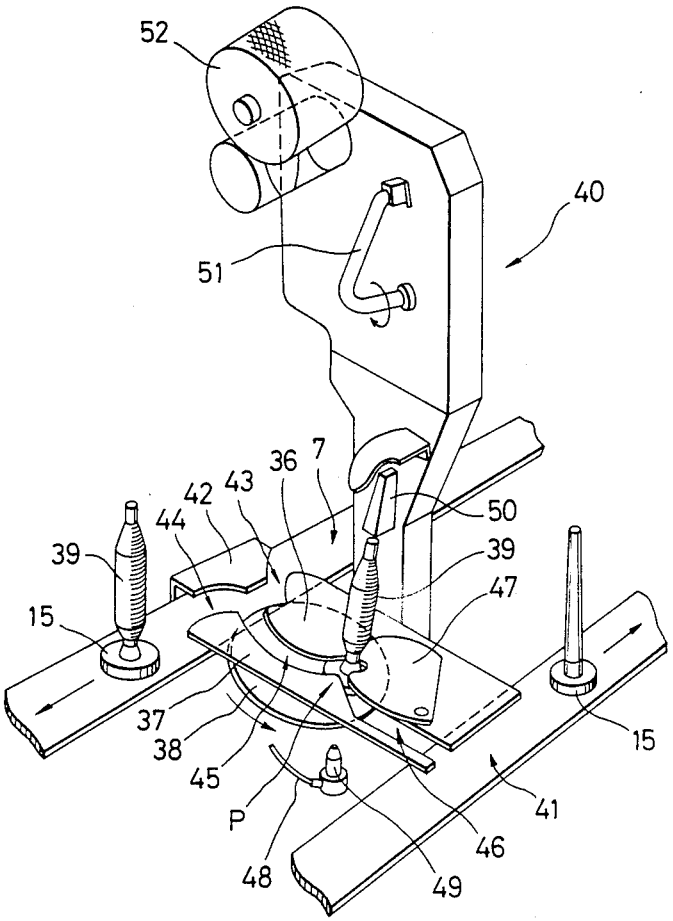
FIG. 6 is a perspective view illustrating a spinning bobbin winding-up treatment in a winding unit.

The winding mechanism will be describe referring to FIG. 6.

FIG. 6 shows one example of the winding unit 40, which is applied to the system thus far described, and a carrier 15 which is a medium for conveying the spinning bobbin. More specifically, the winding unit 40 is arranged between the belt conveyor 7 and the ejecting passage 41 so that the spinning bobbin is transferred to the yarn running position of the winding unit from the belt conveyor 7 by means of a rotary disc 38 and guide plates 36, 37 and 42.

The aforementioned rotary disc 38 is so slightly sloped that its portion at the side of the belt conveyor 7 is at a higher level than that at the side of the ejecting passage 41. Above the rotary disc 38, there are fixed the guide plates 36 and 37 which are positioned at a predetermined spacing from the upper face of the rotary disc 38 and which are formed with the spinning bobbin inlet 43 and an excess spinning bobbin outlet 44 between themselves and the guide plate 42. A spinning belt stand-by line 45 and a bobbin eject line 46 are also formed between the guide plates 36 and 37. Indicated at reference numeral 47 is a turning lever for discharging the empty bobbin and the bobbin with residual yarns at the yarn running position. Below the carrier 15 at the yarn running position P, there is disposed an air injection nozzle 49 which is connected with a conduit 48 leading to a not-shown source of compressed air. The air injected from said nozzle 49 is injected through the space in the peg of the carrier 15 from a port formed in the upper end portion of the peg into a take up tube thereby to blow up the yarn end which has already suspended in said take up tube. Above the spinning bobbin 39 at the yarn running position P, there are additionally disposed: a balloon braker 50. a relay pipe 51 for introducing the yarn end at the spinning bobbin into a not-shown knotting device; a package 52 for taking up the yarn let off from the spinning bobbin: a suction mouth for introducing the yarn end of said package into the knotting device; a slub catcher for detecting a defect of the yarn; and so on.

While the present invention has been described in conjunction with the preferred embodiment in the form of a device for transporting a spinning bobbin, naturally the invention is not limited to the embodiment. For example, articles need not necessarily be transported while they are held carried on carrying elements like the carriers in the embodiment, and in case articles can be identified directly depending upon configurations or colors of articles themselves or upon identification marks applied or printed on the articles, they may otherwise be transported without being carried on carrying elements and may be sorted by cooperation of the identifying means with a mechanical forcing means which is mounted for displacement between adjacent conveyors. Meanwhile, directions of movement of conveyors in circulating paths are selected arbitrarily, and the circulating directions may possible by reversed in the example described above. The transporting device of the invention can also be applied to a system which sorts a plurality of different kinds of articles in order to work the thus sorted article by different processes.

The construction of the present invention provides various effects as described below.

In particular, even if the number of different kinds of articles is increased to any number, only three belt conveyors are required and hence a floor area occupied by the belt conveyors is restricted to small. Circulating paths allow articles which have not been treated immediately to be circulated therealong in a stand-by condition. Accordingly, even if balancing between a supplying speed of articles and a treating speed is temporarily lost, there is no fear of stopping of functions of the entire transporting device due to accumulation of articles waiting for treatment. Even if the number of kinds of articles is increased or decreased and it becomes necessary to change the contents of sorting treatment, resulting in the necessity of changing the number and length of circulating paths, there is no necessity of changing the location of the article sorting means and the guide member nor of modification or relocation of any belt conveyor.

What is claimed is

1. A device for sorting and transporting a plurality of articles comprising:

first, second and third belt conveyors disposed in mutually parallel relationship to each other, said first and second belt conveyors being mutually adjacent and said second and third belt conveyors being mutually adjacent, said first and third belt conveyors moving in a direction opposite to said second belt conveyor, first and second guide members being designed such that said first guide member directs said articles from said second belt conveyor to said third belt conveyor and said second guide member directs said articles from said third belt conveyor to said second belt conveyor to thereby form a circulating path for said articles, and a sorting mechanism for identifying and sorting articles transported on said first belt conveyor so as to cause articles identified and sorted by said sorting mechanism to be moved from said first belt conveyor to said second belt conveyor, wherein said article is a spinning bobbin supported on a carrier, said carrier having a base plate portion configured to rest upon said first, second or third conveyors; and wherein said carrier includes an identifying groove formed in said base plate portion, the height at which said identifying groove is positioned being differentiated depending upon the kind of spinning bobbin supported on said carrier, wherein said sorting mechanism includes a stationary sorting gauge positioned at a fixed height above said first belt conveyor to thereby encounter the base plate portion of the carriers resting on said first belt conveyor;

whereby the carriers having an identifying groove whose height is not coincident with the height of the sorting gauge are moved from said first belt conveyor to said second belt conveyor.

2. A device as claimed in claim 1 further comprising:

an article delivering port adjacent said third conveyor for removing said articles from said third conveyor.

* * * * *